US008344319B2

(12) United States Patent
Kenttamaa et al.

(10) Patent No.: US 8,344,319 B2
(45) Date of Patent: Jan. 1, 2013

(54) LASER-INDUCED ACOUSTIC DESORPTION/ATMOSPHERIC PRESSURE CHEMICAL IONIZATION OF COMPOUNDS

(75) Inventors: Hilkka I. Kenttamaa, West Lafayette, IN (US); David Jesse Borton, II, West Lafayette, IN (US); Jinshan Gao, West Lafayette, IN (US); Zhicheng Jin, West Lafayette, IN (US); Benjamin Curtis Owen, West Lafayette, IN (US)

(73) Assignee: Purdue Research Foundation, West Lafayette, IN (US)

( * ) Notice: Subject to any disclaimer, the term of this patent is extended or adjusted under 35 U.S.C. 154(b) by 91 days.

(21) Appl. No.: 13/080,597

(22) Filed: Apr. 5, 2011

(65) Prior Publication Data

US 2011/0272571 A1 Nov. 10, 2011

Related U.S. Application Data

(60) Provisional application No. 61/320,917, filed on Apr. 5, 2010.

(51) Int. Cl.

| | |
|---|---|
| ***H01J 49/10*** | (2006.01) |
| ***H01J 27/02*** | (2006.01) |
| ***H01J 49/40*** | (2006.01) |
| ***H01J 49/26*** | (2006.01) |

(52) U.S. Cl. ..... 250/288; 250/282; 250/423 P; 250/423 R

(58) Field of Classification Search ..... 250/281, 250/282, 288, 423 R, 423 P, 424, 425
See application file for complete search history.

(56) References Cited

U.S. PATENT DOCUMENTS

| | | | | |
|---|---|---|---|---|
| 7,619,217 | B2 * | 11/2009 | Shea et al. | 250/288 |
| 7,645,987 | B2 * | 1/2010 | Chang et al. | 250/288 |
| 8,138,472 | B2 * | 3/2012 | Chen et al. | 250/282 |
| 2006/0284074 | A1 * | 12/2006 | Chang et al. | 250/288 |
| 2007/0131871 | A1 * | 6/2007 | Chang et al. | 250/427 |
| 2007/0295902 | A1 * | 12/2007 | Shea et al. | 250/288 |
| 2008/0308722 | A1 * | 12/2008 | Shiea | 250/281 |
| 2010/0276582 | A1 * | 11/2010 | Chen et al. | 250/282 |
| 2011/0220787 | A1 * | 9/2011 | Shiea | 250/288 |
| 2012/0079894 | A1 * | 4/2012 | Van Berkel et al. | 73/863.11 |
| 2012/0126112 | A1 * | 5/2012 | Chen et al. | 250/287 |

OTHER PUBLICATIONS

Marshall, Alan G. et al, "Petroleomics: Chemistry of the Underworld", PNAS, Nov. 25, 2008, vol. 105, No. 47, pp. 18090-18095.

(Continued)

*Primary Examiner* — Bernard E Souw
(74) *Attorney, Agent, or Firm* — Faegre Baker Daniels LLP

(57) ABSTRACT

The present disclosure provides a novel system and method for evaporating and ionizing compounds comprising an LIAD source and an ionization source that operates at atmospheric pressure. This system is readily adaptable for use with most commercially available mass spectrometers. Ionization sources include Atmospheric Pressure Chemical Ionization sources (APCI) and Atmospheric Pressure Photo Ionization (APPI) sources. The ionization sources are positioned such that the analyte desorbing from the surface of the LIAD is fed into the ion stream produced by the ionization source and ionized analyte and ionized fragments of the analyte are fed into the sample inlet of a mass spectrometer. These systems allow for the mass spectrometric analysis of non-polar compounds that lack readily ionizable functional groups, such as saturated and unsaturated hydrocarbons and compounds with medium to low polarity, as well as hydrocarbon mixtures, such as petroleum.

35 Claims, 4 Drawing Sheets

OTHER PUBLICATIONS

Pinkston, David S. et al, "Analysis of Asphaltenes and Asphaltene Model Compounds by Laser-Induced Acoustic Desorption/Fourier Transform Ion Cyclotron Resonance Mass Spectrometry", Sep. 16, 2009, American Chemical Society, Energy Fuels Article 2009, vol. 23, pp. 5564-5570.

Crawford, Kenroy E. et al, "Laser-Induced Acoustic Desorption/Fourier Transform Ion Cyclotron Resonance Mass Spectrometry for Petroleum Distillate Analysis", Analytical Chemistry, Dec. 15, 2005, vol. 77, No. 24, pp. 7916-7923.

Duan, Penggao, et al, "Analysis of Base Oil Fractions by C1Mn($H_2O$)+ Chemical Ionization Combined with Laser-Induced Acoustic Desorption/Fourier Transform Ion Cyclotron Resonance Mass Spectrometry", Analytical Chemistry, Mar. 15, 2008, vol. 80, No. 6, pp. 1847-1853.

Duan, Penggao, et al, "Gas-Phase Reactions of C1Mn($H_2O$)+ with Polar and Nonpolar Hydrocarbons in a Mass Spectrometer", J. Am. Chem. Soc., 2007, vol. 129, pp. 9266-9267.

Campbell, J. Larry et al, "Analysis of Saturated Hydrocarbons by Using Chemical Ionization Combined with Laser-Induced Acoustic Desorption/Fourier Transform Ion Cyclotron Resonance Mass Spectrometry", Analytical Chemistry, Feb. 15, 2004, vol. 76, No. 4, pp. 959-963.

Campbell, J. Larry et al, "Analysis of Polyethylene by Using Cyclopentadienyl Cobalt Chemical Ionization Combined with Laser-Induced Acoustic Desorption/Fourier Transform Ion Cyclotron Resonance Mass Spectrometry", Analytical Chemistry, Jul. 1, 2005, vol. 77, No. 13, pp. 4020-4026.

Shea, Ryan C. et al, "Characterization of Laser-Induced Acoustic Desorption Coupled with Fourier Transform Ion Cyclotron Resonance Mass Spectrometer", Analytical Chemistry, Sep. 1, 2006, vol. 78, No. 17, pp. 6133-6139.

Shea, Ryan C. et al, "Design and Characterization of a High-Power Laser-Induced Acoustic Desorption Probe Coupled with a Fourier Transform Ion Cyclotron Resonance Mass Spectrometer", Analytical Chemistry, Apr. 1, 2007, vol. 79, No. 7, pp. 2688-2694.

Peng, Wen-Ping et al, "Laser-Induced Acoustic Desorption Mass Spectrometry of Single Bioparticles", Angewandte Chem. Int., Ed. 2006, 45, pp. 1423-1426.

Habicht, Steven C. et al, "Laser-Induced Acoustic Desorption Coupled with a Linear Quadrupole Ion Trap Mass Spectrometer", Analytical Chemistry, Jan. 15, 2010, vol. 82, No. 2, pp. 608-614.

Cheng, Sy-Chyi et al, "Using Laser-Induced Acoustic Desorption/Electrospray Ionization Mass Spectrometry to Characterize Small Organic and Large Biological Compounds in the Solid State and in Solution Under Ambient Conditions", Analytical Chemistry, Feb. 1, 2009, vol. 81, No. 3, pp. 868-874.

Horning, E.C. et al, "New Picogram Detection System Based on a Mass Spectrometer with an External Ionization Source at Atmospheric Pressure", Analytical Chemistry, May 6, 1973, vol. 45, No. 6, pp. 936-943.

Dzidic, I. et al, "Comparison of Positive Ions Formed in Nickel-63 and Corona Discharge Ion Sources Using Nitrogen, Argon, Isobutane, Ammonia and Nitric Oxide as Reagents in Atmospheric Pressure Ionization Mass Spectrometry", Analytical Chemistry, Oct. 1976, vol. 48, No. 12, pp. 1763-1768.

Sunner, Jan et al, "Factors Determining Relative Sensitivity of Analytes in Positive Mode Atmospheric Pressure Ionization Mass Spectrometry", Anal. Chem. 1988, vol. 60, pp. 1300-1307.

McNeal, C.J. et al, "Thin Film Deposition by the Electrospray Method for Californium-252 Plasma Desorption Studies of Involatile Molecules", Analytical Chemistry, Oct. 1979, vol. 51, No. 12, pp. 2036-2039.

Herrera, Lisandra Cubero et al, "Quantitative Aspects of and Ionization Mechanisms in Positive-Ion Atmospheric Pressure Chemical Ionization Mass Spectrometry", Elsevier, Inc. on behalf of American Society for Mass Spectrometry, Jul. 23, 2008, pp. 1926-1941.

* cited by examiner

LASER-INDUCED ACOUSTIC DESORPTION/ATMOSPHERIC PRESSURE CHEMICAL IONIZATION OF COMPOUNDS

PRIORITY CLAIM

This application claims the benefit of U.S. provisional patent application No. 61/320,917 filed on Apr. 5, 2010, which is hereby incorporated by reference in its entirety.

STATEMENT OF GOVERNMENT RIGHTS

This invention was made with government support from the National Institutes of Health under grant number R01GM052418 and the National Science Foundation under grant number CHE-0911629. The U.S. government has certain rights in the invention.

FIELD OF THE DISCLOSURE

The present disclosure relates to a novel system and method for evaporating and ionizing compounds. More particularly, the present disclosure relates to the use of acoustic desorption coupled to an atmospheric pressure ionization source in a mass spectrometer.

BACKGROUND OF THE DISCLOSURE

Mass spectrometry, in general, is a powerful technique for detection of minute or trace levels of compounds, and combinations thereof. With the development of electrospray ionization mass spectrometry (ESI) and matrix-assisted laser desorption ionization (MALDI), both soft evaporation/ionization methods, it became possible to nearly simultaneously evaporate and ionize large, thermally labile molecules. These advancements further enabled the use of mass spectrometry in biology and the life sciences. However, ESI and MALDI methods are biased toward polar and ionic compounds and are therefore not ideal for studying non-polar compounds in their natural state. Additionally, the ionization of analytes in ESI and MALDI is limited to protonation, deprotonation, or cation attachment, thus the study of nonpolar compounds remains difficult. Further, ESI and MALDI methods are not suited for ionizing analytes which do not comprise easily ionizable functional groups, such as saturated and unsaturated hydrocarbons [1]. Accordingly, there exists a need for additional equipment and methods of preparing analytes that are not readily ionizable for analysis by mass spectrometry some aspects of the invention disclosed herein addresses this need.

SUMMARY OF THE DISCLOSURE

According to the present disclosure, laser-induced acoustic desorption is coupled to an atmospheric pressure ionization source in order to generate gaseous ions. The system of the present disclosure is well suited for use in mass spectrometry.

Some embodiment of the disclosure provide an apparatus for producing gaseous ions, comprising a laser-induced acoustic desorption probe including a surface suitable for contact with an analyte and an ion source that operates at atmospheric pressure. The ion source in these embodiments produces a stream of ions and the surface of the desorption probe is positioned such that it can introduce an analyte on the surface of the desorption probe into the stream of ions produced by the ion source.

In some of these embodiments, the apparatus is suitable for providing at least one ionized analyte or fragment thereof into the sample inlet of a mass spectrometer. In some of these further embodiments, the mass spectrometer is a quadrupole ion trap mass spectrometer. In other embodiments the mass spectrometer is a Fourier-transform ion cyclotron resonance mass spectrometer. In even other embodiments the mass spectrometer is a quadrupole/time-of-flight mass spectrometer.

In some other embodiments of the apparatus, the ion source is an atmospheric pressure chemical ionization source. In some of these embodiments, the atmospheric pressure chemical ionization source produces a plasma that includes ionization products from at least one gas produced from the group of gasses consisting of: nitrogen, carbon dioxide, xenon and CS. In other embodiments of this apparatus, the atmospheric pressure ionization source produces a plasma that includes ionization products from at least one solvent produced from the group of solvents consisting of: methanol, methanol:water, benzene and carbon disulfide. In even further embodiments of this apparatus, the atmospheric pressure ionization source produces a plasma that includes ionization products from at least one gas produced from the group of gasses consisting of: nitrogen, carbon dioxide, xenon and CS and at least one solvent produced from the group of solvents consisting of: methanol, methanol:water, benzene and carbon disulfide.

In even other embodiments of the apparatus, the ion source is an atmospheric pressure photo ionization source.

In some embodiments of the apparatus, the desorption probe includes a neodymium doped yttrium aluminum garnet laser. According to some of these embodiments of the apparatus, the neodymium doped yttrium aluminum garnet laser operates at a range of between about 450 to about 600 nm. According to other embodiments of the apparatus, the neodymium doped yttrium aluminum garnet laser operates at a range of between about 950 to about 1200 nm.

In other embodiments of the apparatus, the desorption probe includes a foil surface having a first side and a second side and the laser focuses on the first side of the foil and a sample is applied to the second side of the foil. Further, the laser can be pulsed so as to minimize the heating of the sample on the second side of the foil. In some embodiments of this apparatus, the laser is pulsed between about 150 to about 200 times per second.

Some other embodiments of the disclosure provide an apparatus for analyzing a compound in which the apparatus comprises: a laser-induced acoustic desorption probe in which the desorption probe includes a surface suitable for contact with an analyte, an ion source that operates at atmospheric pressure in which the ion source produces a stream of ions. The surface of the desorption probe is positioned such that it can introduce an analyte on the surface of the desorption probe into the stream of ions produced by the ion source. The apparatus also includes a mass spectrometer having a sample inlet and the laser induced acoustic desorption probe is positioned such that the desorption probe desorbs at least a portion of the analyte on the surface of the desorption probe into the ion stream and a least a portion of the analyte or an ionized species or fragment thereof is introduced into the sample inlet of the mass spectrometer.

In some embodiment of this apparatus the ion source is an atmospheric pressure chemical ionization source. In some of these embodiments, the atmospheric pressure chemical ionization source produces a plasma that includes ionization products from at least one gas produced from the group of gasses consisting of: nitrogen, carbon dioxide, xenon and CS. In other embodiments of this apparatus, the atmospheric pressure ionization source produces a plasma that includes ionization products from at least one solvent produced from the group of solvents consisting of: methanol, methanol:water, benzene and carbon disulfide. In even further embodiments of this apparatus, the atmospheric pressure ionization source produces a plasma that includes ionization products from at least one gas produced from the group of gasses consisting of: nitrogen, carbon dioxide, xenon and CS and at least one solvent produced from the group of solvents consisting of: methanol, methanol:water, benzene and carbon disulfide.

In other embodiments of the apparatus, the ion source is an atmospheric pressure photo ionization source.

In some embodiments of the apparatus, the mass spectrometer is a quadrupole ion trap mass spectrometer. In other embodiments the mass spectrometer is a Fourier-transform ion cyclotron resonance mass spectrometer. In even other embodiments the mass spectrometer is a quadrupole/time-of-flight mass spectrometer.

In some embodiments of this apparatus, the desorption probe includes a neodymium doped yttrium aluminum garnet laser. According to some of these embodiments of the apparatus, the neodymium doped yttrium aluminum garnet laser operates at a range of between about 450 to about 600 nm. According to other embodiments of the apparatus, the neodymium doped yttrium aluminum garnet laser operates at a range of between about 900 to about 1200 nm.

In other embodiments of the apparatus, the desorption probe includes a foil surface having a first side and a second side and the laser focuses on the first side of the foil and a sample is applied to the second side of the foil. Further, the laser can be pulsed so as to minimize the heating of the sample on the second side of the foil. In some embodiments of this apparatus, the laser is pulsed between about 150 to about 200 times per second.

Some embodiments of the disclosure provided herein include a method for analyzing a compound comprising the steps of providing an apparatus which includes a laser-induced acoustic desorption probe. The desorption probe includes a surface suitable for contact with an analyte and an ion source that operates at atmospheric pressure and produces a stream of ions. The apparatus also includes a mass spectrometer having a sample inlet. The laser induced acoustic desorption probe is positioned such that the desorption probe desorbs at least a portion of the analyte on the surface of the desorption probe into the ion stream and a least a portion of the analyte or an ionized species or fragment thereof is introduced into the sample inlet of the mass spectrometer. The method also includes the steps of supplying at least one analyte and contacting the surface suitable for contact with an analyte with an analyte.

In some embodiments of this method for analyzing a compound the analyte is a polar compound. In some of these embodiments of the method, the nonpolar compound is a lipid. In some embodiments the nonpolar compound is selected from the group consisting of bathophenanthrolines, Coronenes, squalenes, cholestanes, androsterones, and the like.

In other embodiments of the method for analyzing a compound the analyte is a nonpolar compound. In some of these embodiments of the method, the nonpolar compound is petroleum.

BRIEF DESCRIPTION OF THE DRAWINGS

The above-mentioned and other features of the present disclosure will become more apparent and will be better understood by reference to the following description of embodiments of the present disclosure taken in conjunction with the accompanying drawings, wherein.

DETAILED DESCRIPTION OF THE DISCLOSURE

The embodiments disclosed herein are not intended to be exhaustive or limit the disclosure to the precise forms disclosed in the following detailed description. Rather, the embodiments are chosen and described so that others skilled in the art may utilize their teachings.

The method and system disclosed and described herein provides an application useful for the characterization of both polar and nonpolar organic compounds, and useful for analyzing large saturated hydrocarbons, such as, the large hydrocarbons in petroleum [3].

Figure 1A:
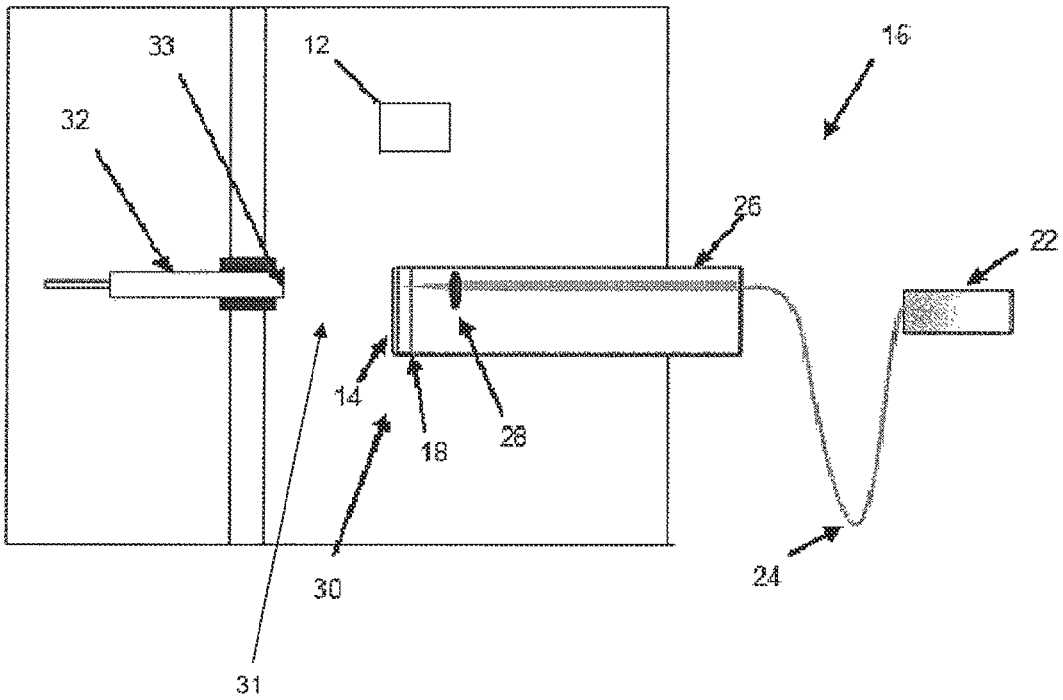
FIG. 1A is a schematic view of an embodiment of the present disclosure illustrating a mass spectrometer system comprising a low power laser-induced acoustic desorption source and an atmospheric pressure ionization source.

Referring to FIG. 1A, an embodiment of a mass spectrometer system 10 according to the disclosed system and method is depicted. As depicted in FIG. 1A, the present disclosure includes laser-induced acoustic desorption (LIAD) source 16 coupled to an ionization source 12. According to the instant disclosure, the ionization source 12 may comprise one of atmospheric pressure chemical ionization source (APCI) 12' (FIG. 1B) and ionization source 12 may also comprise atmospheric pressure photo ionization source (APPI) 12" (FIG. 1C) or another type of atmospheric ionization source as well. An exemplary embodiment of APPI source 12" within the scope of the instant disclosure can be found in U.S. Pat. No. 6,646,256, the disclosure of which is herein expressly incorporated by reference in its entirety.

According to the instant disclosure, mass spectrometer system 10 may comprise various types, or forms, of mass spectrometer systems, including for example, a Fourier-transform ion cyclotron resonance mass spectrometer [8, 9], a quadrupole ion trap [10], a linear quadrupole ion trap mass spectrometer (LQIT) [11], and a quadrupole/time-of-flight mass spectrometer [12]. For consistency and simplicity, as referred to herein mass spectrometer system 10 utilized with the instant disclosure is described in terms of a LQIT mass spectrometer (LTQ available through Thermo Fisher Scientific, Inc.), although any of the above referenced mass spectrometer systems or the like are intended to be included within the present disclosure. Further, exemplified results produced herein are produced according to the system and method disclosed herein utilizing a LQIT mass spectrometer system 10.

LIAD source 16, depicted in FIG. 1A as a low power LIAD, is illustrated comprising laser 22, optical fiber 24, probe portion 26, lens 28 and support stand 30. With reference to the low power LIAD source 16 of FIG. 1A, laser 22 generates a pulse in the form of a beam, which travels through optical fiber 24 (and through probe portion 26) where the beam is focused by lens 28. Further illustrated in FIG. 1A, support stand 30 comprises glass support 18 (exemplified herein as a thin, glass layer having a thickness of approximately 200 μm, although the thickness may vary according in reference to the laser beam generated by laser 22), upon which foil 14 (having the compound of interest deposited thereon) is placed in contact.

Figure 1B:
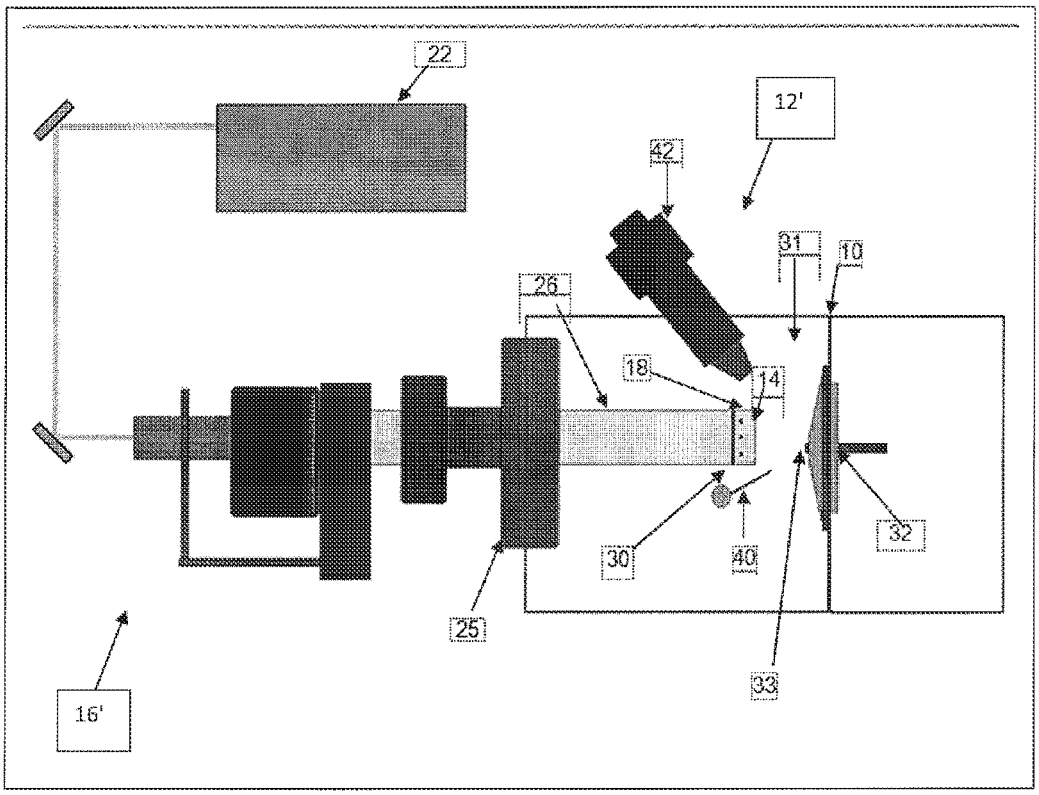
FIG. 1B is a schematic view of an embodiment of the present disclosure illustrating a mass spectrometer system comprising a high power laser-induced acoustic desorption source and an atmospheric pressure chemical ionization source.

With reference to FIG. 1B, a high power LIAD source 16' is depicted. LIAD source 16' also comprises laser 22, probe portion 26, and support stand 30. LIAD 16' further comprises probe adapter 25, which facilitates coupling of probe portion 26 of LIAD source 165' to mass spectrometer system 10. Additionally, LIAD source 16' comprises at least one mirror 23 (illustrated in FIG. 1B as two mirrors 23). Further, as illustrated in FIG. 1B, LIAD source 16' may further comprise focusing attachment 21, which couples to probe adapter 25, and operates to focus and adjust laser beam being provided to probe portion 26. Additional details of embodiments of high power LIAD source 16', within the scope of the system and method disclosed herein, are provided in U.S. Pat. No. 7,619,217, the entire disclosure of which is expressly incorporated by reference herein.

According to an embodiment of the instant disclosure, LIAD source 16, 16' provides a method for evaporating non-volatile and thermally labile compounds as neutral molecules into gas phase (within ionization chamber 31) of mass spectrometer system 10. Further, this evaporation method allows for decoupling the desorption and ionization processes of the disclosed system and method, thereby making it possible to ionize analytes with a variety of methods, such as, electron bombardment [2,3], chemical ionization (CI) [4-7], and photon bombardment (for example, when used in conjunction with an APPI ionization source).

As illustrated in the embodiments of the disclosed systems of FIGS. 1A and 1B, support stand 30 is coupled to an end of probe portion 26 of LIAD source 16, 16'. Further depicted, probe portion 26 is arranged (coupled, affixed, inserted, and/or mounted to mass spectrometer system 10) in conjunction with mass spectrometer system 10 such that foil 14, positioned on support stand 30, orientates compounds deposited on foil 14 within ionization chamber 31 of mass spectrometer system 10. In order to prevent electrical conductance, a plastic front cap of probe portion 26 may be utilized in the disclosed system. According to disclosed embodiments of LIAD source 16, 16', probe portion 26 may be similar to the one described by Shea et al. (having an outer diameter approximately ⅞ in.) [8].

Continuing with FIG. 1A, the system and method disclosed herein further includes foil 14. By way of example, foil 14 may comprise a titanium foil comprising a thickness of approximately 12.5 μm. As shown in FIG. 1A (and applicable to FIG. 1B), foil 14 is supported by support stand 30 of probe portion 26 such that probe portion 26 (more specifically lens 28) focuses a laser beam or pulse on the back side of foil 14. As is described in greater detail herein, an analyte of interest is deposited onto a first side of foil 14, and the orientation of foil 14 when supported on support stand 30 of probe portion 26 is such that the first side of foil 14 is in communication with ionization chamber 31 of mass spectrometer system 10.

With reference to FIG. 1B, ionization source 12 may comprise APCI source 12' including electrode 40 and operation portion 42. According to the instant disclosure, electrode 40 may comprise a wire needle. One exemplary embodiment of electrode 40 according to the instant disclosure is a corona discharge needle. According the present disclosure, operation portion 42 of APCI source 12' includes a power supply electrically coupled to electrode 40 and may include a gas supply feed, which supplies gas such as nitrogen into ionization chamber 31. Additionally, operation portion 42 of APCI source 12' may also comprise components such as a skimmer, a reagent supply component, and a vacuum supply.

Figure 1C:
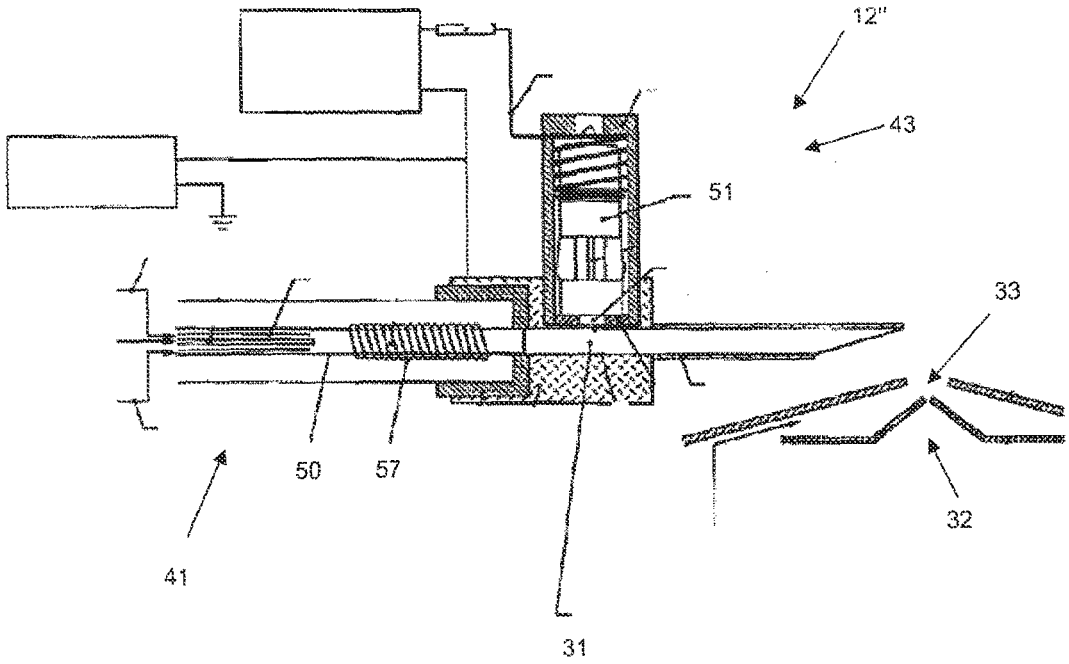
FIG. 1C is a schematic view of an embodiment of the present disclosure illustrating a mass spectrometer system comprising a an atmospheric pressure photoionization source.

With reference to FIG. 1C, it is also within the scope of the present disclosure that ionization source 12 comprise APPI source 12". FIG. 1C depicts APPI source 12" as comprising heated probe portion 41 and APPI lamp portion 43. As used herein the heated probe 41 used to evaporate molecules maybe replace by the LIAD probe and APPI. The APPI source further includes a capillary, 50 with heating element 52, which allows for a gas and APCI solvent system (or both) to be evaporated and introduced into ionization chamber 31 wherein the vaporized gas is exposed to lamp 51 of APPI lamp portion 43 (and thereby ionized). As is further depicted, capillary 50 provides a guide for ionized molecules to opening 33 of ion transfer capillary 32. LIAD source 16 is not depicted in FIG. 1C. An exemplary APPI source 12" which is within the scope of the instant disclosure includes the APPI source disclosed in U.S. Pat. No. 6,523,765, the disclosure of which is herein expressly incorporated by reference in its entirety.

Atmospheric-pressure chemical ionization systems were first developed in the 1970s (called atmospheric ionization at that time) [13, 14]. The first systems which performed atmospheric-pressure chemical ionization utilized a nickel-63 radiation source as a source of electrons. ESI, a later atmospheric-pressure chemical ionization system, is popular for its ability to ionize large proteins. Later, a corona discharge electrode (an embodiment of electrode 40 in APCI source 12' of FIG. 1B) was developed for providing the source of electrons within ionization chamber 31. Electrode 40 (depicted herein as a corona discharge needle) of APCI source 12' provides the electron source used in ionizing gas molecules, such as $N_2$ (used in the instant disclosure as a sheath gas within ionization chamber 31) and methanol (disclosed below as an APCI solvent system which may be introduced into ionization chamber 31 by operation portion 42). Further, it should be noted that addition of an APCI solvent system (described in further detail below), by operation portion 42 of APCI source 12' or heated probe portion 41 of APPI source 12", may occur in addition to the introduction of an gas, such as nitrogen, carbon dioxide, xenon, or the like, into ionization chamber 31 (wherein the gas phase is produced by ionization source 12). Further, although the gas phase in ionization chamber 31 is referred to as a gas, its state may be more properly referred to as a plasma in at least some instances according to the method and system disclosed herein.

Returning to the embodiment depicted in FIG. 1B, mass spectrometer system 10 includes ion transfer capillary 32. As illustrated in FIG. 1A, ion transfer capillary 32 is orientated in mass spectrometer system 10 such that opening 33 is in spatial communication with ionization chamber 31 (which is in communication with the first side of foil 14 having the analyte of interest deposited thereon). As described herein, the pressure within ionization chamber 31 (at which evaporation by LIAD source 16' and ionization by APCI source 12') is at atmospheric pressure, and is thereby not required to be conducted under a vacuum.

In practice, according to the system and method disclosed herein, an analyte is deposited onto foil 14, which comprises a thin, non-reactive, metallic substrate. Compounds and combinations thereof, utilizable with the disclosed system and method represent a wide variety of different elements and combinations thereof, including nitrogen and oxygen compounds, aromatic and aliphatic compounds, as well as unsaturated and saturated hydrocarbons, for example. The disclosed method and system also provides an application useful for the characterization of both polar and nonpolar organic compounds, and is useful for analyzing large saturated hydrocarbons such as, the large hydrocarbons in petroleum without causing excessive decomposition [3].

Compounds (referred to as an analyte once deposited on foil 14 and eventually evaporated into ionization chamber 31 by LIAD source 16, 16') are deposited on a first side of foil 14. For example, the following chemicals, including 5α-Cholestane (purity 97%), squalene (98%), androsterone (97%), coronene (97%), bathophenanthroline (97%), and carbon disulfide (99.9%) (available from Sigma-Aldrich) may be analyzed by way of the system and method disclosed herein.

According to one exemplary embodiment of the disclosed system, 5α-cholestane may be dissolved in a mixture of dichloromethane and methanol (1:1, v/v) (1.5 mg/mL) and deposited on foil 14. According to another exemplary embodiment, squalene may be dissolved in pure tetrahydrofuran (2.0 mg/mL) and deposited on foil 14 for analysis by the instant system and method. According to yet another embodiment of the instant disclosure, coronene may be dissolved in pure tetrahydrofuran (2.0 mg/mL) and thereafter deposited on foil 14 for analysis according to the instant method and system. According to yet another embodiment of the instant system, bathophenanthroline may be dissolved in pure tetrahydrofuran (2.0 mg/mL) and deposited on foil 14 for analysis by way of the disclosed system. Further, another embodiment of the instant disclosure includes androsterone being dissolved in pure methanol (2.0 mg/mL) and thereafter deposited on foil 14 for analysis with the disclosed method and system. Deposition of, for example, 60-80 μL of one of the dissolved solutions (described above) onto a first side of foil 14 in accordance with the disclosed system and method may be accomplished through electrospray deposition [16].

Foil 14 (having the analyte of interest deposited thereon) is positioned in contact with glass support 18 of support stand 30, as illustrated in FIG. 1A, such that the first side of foil 14 is orientated facing ionization chamber 31. Desorption of the analyte (deposited on the first side of foil 14) occurs by way of laser 22 (exemplified herein as a Nd:YAG Laser, available from Minilite II, Continuum Lasers) emitting high-intensity laser pulses which are focused via lens 28 onto the back side of foil 14.

Repeated pulsing of laser on the back side of foil 14 generates laser induced shock-waves which propagate through foil 14. According the instant disclosure, propagation of the laser-induced shock waves by LIAD source 16, 16' causes evaporation of only neutral molecules (deposited on the first side of foil 14) into the gas phase within the ionization chamber 31 of mass spectrometer system 10. As disclosed herein, because the laser pulses do not interact with the analytes directly, the chemical structures of the analytes are not altered, the desorbed neutral molecules are not degraded, and the desorbed neutral molecules possess low kinetic and internal energies [8].

According to an embodiment of the instant disclosure depicted by FIG. 1B, high power LIAD source 16' may comprise laser 22 consisting of a Nd:YAG laser (available from Minilite II, Continuum Lasers) wherein the plurality of laser pulses generated by laser 22 may comprise the following characteristics: 532 nm; 3 ns pulse width; and 10 Hz. With reference to FIG. 1B, the laser pulses travel from laser 22 and are reflected by mirror(s) 23 and are focused (by lens 28) on an area of about 10-3 $cm^2$ on the back side surface of foil 14. An exemplary output energy of a laser pulse, according to the instant disclosure further includes a 3.6 mJ/pulse (measurable by pyroelectric meter, PE25-SH, OPHIR Laser Measurement) which corresponds to a power density of about 8×108 $W/cm^2$ at the back surface of foil 14.

Additionally, according to the disclosed system and method, during laser-induced acoustic desorption of the analyte deposited on foil 14, the outer cylinder of probe portion 26 of LIAD source 16, 16' may be rotated, for example, after a predetermined number of laser pulses or an amount of time. Rotation of the outer cylinder of probe portion 26 thereby rotates glass support 18 of support stand 30 (upon which foil 14 is positioned or coupled). Rotation of support stand 30 thereby rotates foil 14, allowing analytes from multiple sites of foil 14 to be better desorbed into gas phase of ionization chamber 31. By way of further example, laser pulsations may be applied to back side of foil 14 as original configured on support stand 30 for a given amount of time or a given number of laser pulsations (for example 180 pulsations). Following the given amount of time or number of laser pulses, foil 14 may then be rotated 90° (in a manner as described above) so that another one-fourth of foil's 14 area may be contacted by the laser pulsations, thereby aiding in better desorbing analytes deposited on the corresponding area of the first side of foil 14.

Additionally, according to an embodiment of the instant disclosure, heating of probe portion 26, and thereby analytes deposited on foil 14 (through conduction and/or convection), may be prevented by placing probe portion 26 of LIAD source 16 into position in relation to mass spectrometer system 10 (which thereby places probe portion 26 in relatively close proximity to electrode 40 of ionization source 12) just prior to activating laser 22 and removing probe portion 26 immediately following use in each experiment.

Analytes evaporated into the gas phase within the ionization chamber 31 of mass spectrometer system 10 are thereby ionized by way of APCI source 12.

According to an embodiment of the present disclosure depicted in FIG. 1B, operation portion 42 of APCI source 12' provides a gas (such as $N_2$) to ionization chamber 31 of mass spectrometer system 10. Further, operation portion 42 provides power to electrode 40, such as a corona discharge needle, which provides an electron source to the gas phase in ionization chamber 31 and thereby ionizes the $N_2$ gas. It is also within the scope of the disclosed system and method that an APCI solvent system (or reagent) will be introduced to ionization chamber 31 (possibly by way of operation portion 42). Various APCI solvent systems are utilizable with the system and method disclosed herein. By way of example, and not intended to limit the instant disclosure in any way, exemplary APCI solvent systems may comprise, for example: a mixture of methanol and water; neat (undiluted) benzene; and neat carbon disulfide ($CS_2$). Electrode 40 ionizes an APCI solvent system which is introduced to ionization chamber 31. Further, ionization of the APCI solvent system effectively reduces the APCI solvent system to an ionized plasma state.

As disclosed herein, utilization of different APCI solvent systems with the instant system and method yield drastically dissimilar mass spectra results when used in conjunction with different analytes (or combinations thereof) deposited on foil 14. For example, use of a methanol and water mixture (1:1, v/v) as an APCI solvent system produces primarily protonated molecules when bathophenanthroline is deposited on foil 14 and ionized according to the instant system and method. However, when the same APCI solvent system is used with 5α-cholestane deposited on foil 14 and ionized according to the system and method disclosed herein, no detectable ions are observed by mass spectrometry. In general, ionization of basic compounds with the disclosed system utilizing a methanol and water APCI solvent system yields cationic ions. However, saturated hydrocarbons ionized under the same conditions generally do not yield molecules that are detectable using conventional mass spectrometry.

In contrast to the use of methanol and water (as the APCI solvent system), use of the system and method disclosed herein with neat benzene or neat carbon disulfide ($CS_2$) as the APCI solvent system results in ionization of a wide variety of elements and combinations thereof. Electron transfer reactions play a role in these APCI solvent systems, as analyte radical cations, potentially accompanied by protonated analytes, may occur.

APCI solvent systems of benzene, according to the instant disclosure, generates only minor, if any, fragmented ions due to the analyte being ionized by electron abstraction by the radical cation of benzene which is a low energy process. With $CS_2$, more abundant fragment ions form, presumably due to formation of higher energy molecular ions due to the greater recombination energy of $CS_2$ compared to benzene. The use of either benzene or $CS_2$ as an APCI solvent system, in the disclosed system and method, for aiding in creating ionized gas phase analytes within ionization chamber 31, provides capabilities for ionizing both polar and nonpolar compounds and allows for the evaporation of large, thermally labile compounds without dissociation or aggregation. As such, the system and method of the instant disclosure is also applicable to the characterization of complex mixtures.

According to an embodiment of the present disclosure, an APCI solvent system may be introduced into ionization chamber 31 (according to the system and methods described herein) in combination with the introduction of gas molecules such as $N_2$. Additionally, APCI solvent systems may be introduced into ionization chamber 31 alone (thus without gas molecules such as $N_2$ already or co-introduced into ionization chamber 31). It should be understood that ionization of gas and/or an APCI solvent system by electrode 40 (depicted herein as a corona discharge needle) of APCI system 12' (FIG. 1B) ionizes the gas molecules and APCI solvent system, thereby forming, for example, radical cations in the positive ion mode of mass spectrometer system 10 [15]. According to the instant method and system disclosed herein, at least one of these ionized molecules may collide with the vaporized solvent molecules thereby potentially forming secondary reactant ions (usually protonated methanol if methanol is used as a solvent) and cluster ions of the type $H^+(H_2O)_n$ and $H^+(CH_3OH)_n$. Protonation of the analyte molecules is usually observed in positive-mode APCI when using methanol solvent, although molecular ions and their fragments can also be formed.

Exemplary conditions utilizable with APCI source 12' (FIG. 1B) include: vaporizer temperature, 400-450° C.; nitrogen sheath gas, 40-50 (arbitrary units); nitrogen auxiliary gas, 5 (arbitrary units); capillary temperature, 275° C.; and MS scan range, m/z 50-500. Exemplary flow rates of APCI solvent systems according to the disclosed system and method include 50 μL/min for a mixture of methanol and water (1:1, v/v) and 5-10 μL/min for APCI solvent systems comprising benzene and $CS_2$. The use of other conditions, solvents, gases, and the like are within the scope of the disclosure and may be determined in part by the analyte of interest, impurities in the sample and the particular configuration of the system being used.

According to one of the methods and systems disclosed herein, LIAD source 16 is coupled with ionization source 12 in conjunction with mass spectrometer system 10 allowing for analysis of analytes that are not amenable to other ionization systems, such as those employed in LIAD/ESI experiments, for example. Since ionization source 12 (used in combination with the disclosed system and method) is capable of ionizing compounds with medium to low polarity, this approach allows for the analysis of hydrocarbon mixtures, such as petroleum.

EXAMPLES

Example 1

Selection of Experimental Compounds for Ionization and Mass Spectrometer Measurement To evaluate the performance of the disclosed system and method utilizing the above described combination and orientations of LIAD source 16 and ionization source 12, five known model compounds of different types (illustrated in Scheme 1) were analyzed according to the system and method disclosed herein. The selected compounds are structurally similar to compounds commonly present in petroleum, ranging from hydrocarbons to polar compounds. As described herein, all five analytes were successfully evaporated into ionization chamber 31 of mass spectrometer system 10 by way of with LIAD source 16. Further, although it should be understood that any of the embodiments described herein may be utilized, the Examples provided herein were performed using the embodiments depicted in FIG. 1B comprising APCI source 12'.

Further described herein these examples, three different APCI solvent systems (a. methanol and water (1:1, v/v); neat benzene, and; neat carbon disulfide) were employed in conjunction with APCI source 12' for ionizing the evaporated analytes. The mass spectrometry measurements for each analyte using each of the three different solvents are discussed below.

Scheme 1. Chemical structures of the five model compounds used in this study

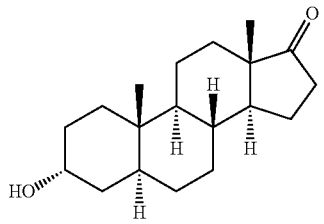

Androsterone

-continued

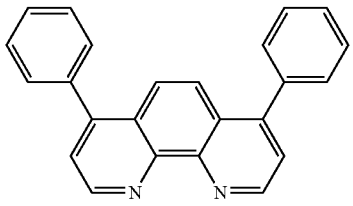

Bathophenanthroline

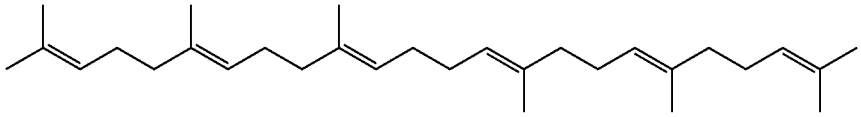

Squalene

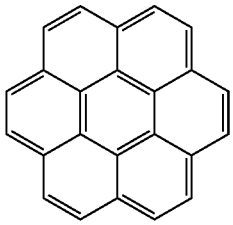

Coronene

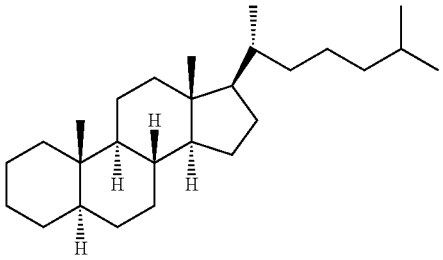

5α-Cholestane

Example 2

Ionization and Mass Spectrometry of Bathophenanthroline

Example 2.1

Solvent System of Methanol and Water Mixture (1:1, v/v)

Bathophenanthroline was deposited on foil 14 in accordance with the manners described above. Use of APCI solvent system of methanol and water (1:1, v/v) in conjunction with APCI source 12 for ionization of bathophenanthroline yielded only protonated methanol and its cluster ion, $H^+(CH_3OH)_2$. The mixture of protonated methanol and $H^+(CH_3OH)_2$ ionized evaporated analytes. Mass spectrometry system 10 results of the heteroaromatic analyte bathophenanthroline (FIG. 2), ionized according to the instant disclosure, resulted in production of only stable protonated molecules.

Figure 2:
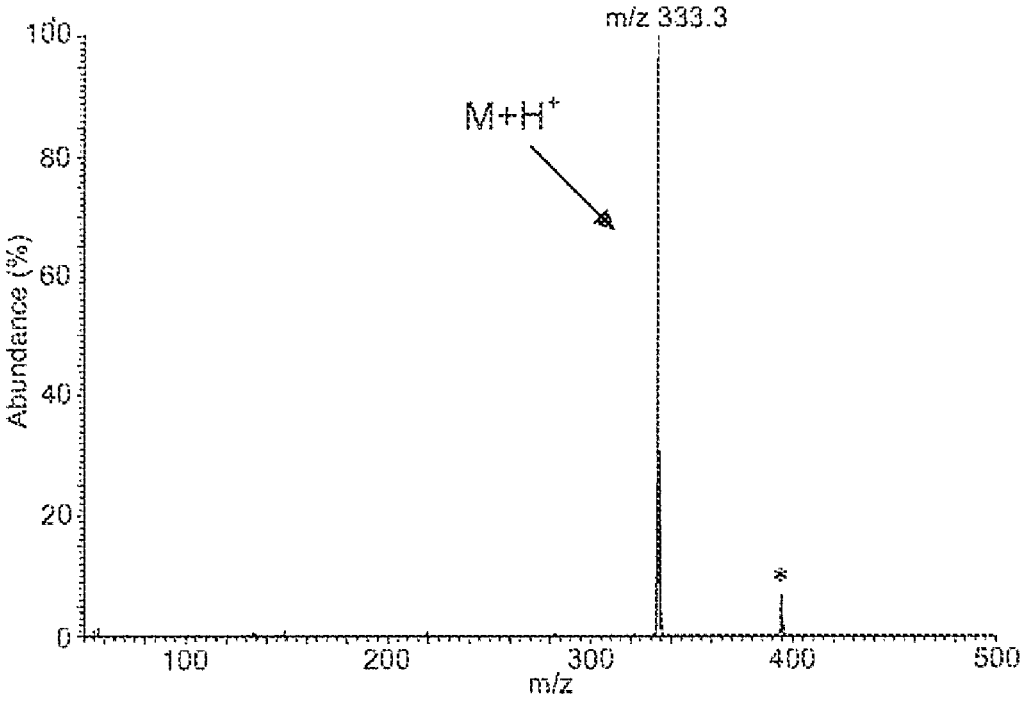
FIG. 2 is a mass spectrum of bathophenanthroline (in positive ion mode) generated according to the disclosed system and method; and Corresponding reference characters indicate corresponding parts throughout the several views. Although the drawings represent embodiments of the present disclosure, the drawings are not necessarily to scale and certain features may be exaggerated in order to better illustrate and explain the present disclosure.

With reference to FIG. 2, LIAD/APCI positive ion mass spectrum of bathophenanthroline is shown. FIG. 2 represents ionization of bathophenanthroline according to the instant disclosure using a methanol and water (1:1, v/v) APCI solvent system. As shown by the positive ion mass spectrum of FIG. 2, ionization of bathophenanthroline according to the instant disclosure produces only a mass-to-charge ratio value (in positive ion mode) of 333.3.

Example 2.2

Solvent System of Benzene

Use of the disclosed system and method (having bathophenanthroline deposited on foil 14) with benzene as the APCI solvent system generates a predominance of the benzene molecular ions (radical cations). This results to the formation of analyte molecular ions since the ionization energy (IE) of the bathophenanthroline analyte is lower than that of benzene (9.24 eV). For bathothenanthroline, when a benzene APCI solvent system was utilized with the instant system, both molecular ions and protonated molecules were observed (Table 1).

Example 2.3

Solvent System of Carbon Isulfide ($CS_2$)

Carbon disulfide ($CS_2$) was also utilized as an APCI solvent system in the disclosed system and method in which bathophenanthroline was deposited on foil 14. In comparison to a benzene APCI solvent system, $CS_2$ has a higher ionization energy (IE=10.07 eV) than benzene (IE=9.24 eV).

It was observed that utilizing a CS2 APCI solvent system with the instant system and method that less proton transfer, and more efficient electron transfer occurred. Additionally, it was observed that the branching ratio of proton transfer was low (Table 1).

Example 3

Ionization and Mass Spectrometry of Coronene

Example 3.1

Solvent System of Methanol and Water Mixture (1:1, v/v)

Coronene was deposited on foil 14 in accordance with the manners described above. Mass spectrometry system 10 results of the coronene analyte, ionized according to the instant disclosure using an APCI solvent system consisting of methanol and water (1:1, v/v), resulted in the production of only stable protonated molecules (Table 1).

Example 3.2

Solvent System of Benzene

Use of the disclosed system and method (having coronene deposited on foil 14) with benzene as the APCI solvent system generates nearly equivalent amounts of protonated molecule (48%) the benzene molecular ions (radical cations) (52%) (Table 1). Further, use of a benzene solvent system in the disclosed method and system (with coronene deposited on foil 14) produced no observable fragmentation.

Example 3.3

Solvent System of Carbon Disulfide ($CS_2$)

Use of the disclosed system and method (having coronene deposited on foil 14) with $CS_2$ as the APCI solvent system also generates both protonated molecules and the benzene molecular ions (radical cations). However, only a very small amount of protonated molecules (9%) was produced with $CS_2$ as the APCI solvent system (Table 1). Further, use of a $CS_2$ solvent system in the disclosed method and system (with coronene deposited on foil 14) also produced no observable fragmentation.

Example 4

Ionization and Mass Spectrometry of Squalene

Example 4.1

Solvent System of Methanol and Water Mixture (1:1, v/v)

Squalene was deposited on foil 14 in accordance with the manners described above. Mass spectrometry results of the squalene analyte, ionized according to the instant disclosure using an APCI solvent system consisting of methanol and water (1:1, v/v), yielded predominantly protonated molecules (branching ratio: 95%) (Table 1). Additionally, use of methanol and water solvent in the disclosed method and system (with squalene deposited on foil 14) produced only a small amount of observable fragmentation.

Example 4.2

Solvent System of Benzene

Use of the disclosed system and method (having squalene deposited on foil 14) with benzene as the APCI solvent system generates both protonated molecule (branching ratio: 7%) and molecular ions (76%) (Table 1). Further, use of a benzene APCI solvent system in the disclosed method and system (with squalene deposited on foil 14) produced a small amount of observable fragmentation.

Example 4.3

Solvent System of Carbon Disulfide ($CS_2$)

When using the disclosed system and method (having squalene deposited on foil 14) with $CS_2$ as the APCI solvent system, the branching ratio of the protonated molecules was only 8%. No fragment ions were observed with the branching ratio of the molecular ions being 92%.

Example 5

Ionization and Mass Spectrometry of 5α-Cholestane

Example 5.1

Solvent System of Methanol and Water Mixture (1:1, v/v)

5α-Cholestane, a saturated hydrocarbon, was deposited on foil 14 in accordance with the manners described above. When the system and method disclosed herein was utilized with a methanol and water mixture as the APCI solvent system, mass spectrometry results yielded no detectable ions (Table 1).

Example 5.2

Solvent System of Benzene

Use of the disclosed system and method (having 5α-cholestane deposited on foil 14) with benzene as the APCI solvent system generated a mass spectrum dominated by molecular ions (branching ratio: 80%). Further, use of a benzene APCI solvent system in the disclosed method and system (with 5α-cholestane deposited on foil 14) produced a small amount of observable fragmentation (Table 1).

Example 5.3

Solvent System of Carbon Disulfide ($CS_2$)

Use of the disclosed system and method (having 5α-cholestane deposited on foil 14) with $CS_2$ as the APCI solvent system generated a mass spectrum nearly identical to the spectrum generated with a benzene APCI solvent system. As shown in table 1, use of the disclosed system and method with $CS_2$ as the solvent system generated a spectrum dominated by molecular ions (branching ratio: 81%) and produced a small amount of observable fragmentation (Table 1).

Example 6

Ionization and Mass Spectrometry of Androsterone

Example 6.1

Solvent System of Methanol and Water Mixture (1:1, v/v)

When a mixture of methanol and water (1:1, v/v) was employed as the APCI solvent system in the disclosed system and method wherein androsterone has been deposited on foil 14 in accordance with the manners described above, androsterone yields some protonated molecules (46%) but in general their fragment ions dominate the spectrum (Table 1).

Example 6.2

Solvent System of Benzene

Use of the disclosed system and method (having androsterone deposited on foil 14) with benzene as the APCI solvent system generated a mass spectrum dominated by molecular ions (87%) and minor protonated molecules (4%) also observable.

Example 6.3

Solvent System of Carbon Disulfide ($CS_2$)

When $CS_2$ was used as the APCI solvent system in the disclosed system and method, major molecular ions (73%) were formed (Table 1).

Results

As demonstrated by the examples presented herein, LIAD source 16 was successfully combined with APCI source 12 in the mass spectrometer system 10 disclosed herein. As also further provided, altering the APCI solvent system, in accordance with the analyte deposited on foil 14, yields different mass spectra.

An APCI solvent system consisting of a mixture of methanol and water was found to produce protonated molecules for polar compounds (deposited on foil 14) while nonpolar compounds (deposited on foil 14) produced no detectable ions. Both molecular ions and protonated molecules (likely formed in secondary reactions) are shown herein for polar compounds when benzene or $CS_2$ was used as the APCI solvent system. Both of these APCI solvent systems also lead to ionization of nonpolar analytes, including saturated hydrocarbons. Predominant molecular ions were formed.

There are several advantages associated with the system and method disclosed herein, in which LIAD source 16 and APCI source 12 are combined with mass spectrometer system 10. For example, the system and method disclosed herein is able to detect both nonpolar and polar compounds simultaneously. Also, sample handling is much simpler when ambient conditions are employed for sample introduction rather than high vacuum. Further, rastering the LIAD system 16 foil 14 is in general much more straightforward under atmospheric pressure than in high vacuum, thus enabling LIAD source 16 to be used as a novel imaging tool. Finally, when LIAD source 16 is used under atmospheric pressure, the vacuum effect on foil 14 is removed.

TABLE 1

Ions (with their branching ratios corrected for $^{13}C$ isotype; only ions with branching rations ≧ 5% are listed) formed upon LIAD/APCI of model compounds

| Analyte | Reagent: $CH_3OH/H_2O$ IE = 10.83 eV PA = 754.3 kJ/mol (methanol) | | Benzene IE = 9.24 eV PA = 750.4 kJ/mol | | $CS_2$ IE = 10.07 eV PA = 681.9 kJ/mol | |
|---|---|---|---|---|---|---|
| 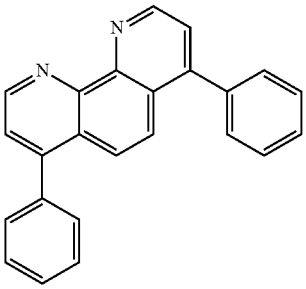 Bathophenanthroline (MW 332) | $M + H^+$ | 100% | $M + H^+$ | 80% | $M + H^+$ | 30% |
| | | | $M^{+\bullet}$ | 20% | $M^{+\bullet}$ | 70% |

TABLE 1-continued

Ions (with their branching ratios corrected for $^{13}C$ isotype; only ions with branching rations ≧ 5% are listed) formed upon LIAD/APCI of model compounds

| Analyte | Reagent: $CH_3OH/H_2O$ IE = 10.83 eV PA = 754.3 kJ/mol (methanol) | | Benzene IE = 9.24 eV PA = 750.4 kJ/mol | | $CS_2$ IE = 10.07 eV PA = 681.9 kJ/mol | |
|---|---|---|---|---|---|---|
| 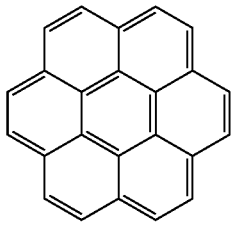 Coronene (MW 300) | $M + H^+$ | 100% | $M + H^+$<br>$M^{+\bullet}$ | 48%<br>52% | $M + H^+$<br>$M^{+\bullet}$ | 9%<br>91% |
| 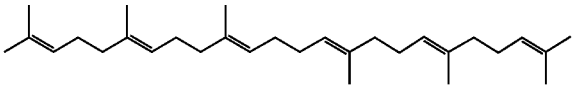 Squalene (MW 410) | $M + H^+$<br>m/z 329 | 95%<br>5% | $M + H^+$<br>$M^{+\bullet}$<br>m/z 341 | 7%<br>76%<br>17% | $M + H^+$<br>$M^{+\bullet}$ | 8%<br>92% |
| | | | $(—(CH_3)_2C{=}CH—CH_2)$ | | | |
| 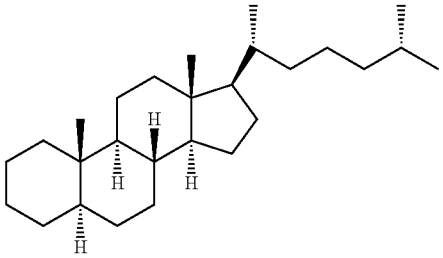 5α-Cholestane (MW 372) | No ions detected | | $M^{+\bullet}$<br>m/z 218 | 80%<br>20% | $M^{+\bullet}$<br>$M - H^+$<br>m/z 218 | 81%<br>8%<br>11% |
| 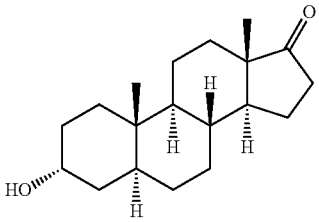 Androsterone (MW 290) | $M + H^+$<br>$M + H^+ - H_2O$<br>$M + H^+ - 2H_2O$ | 46%<br>45%<br>9% | $M + H^+$<br>$M^{+\bullet}$<br>$M + H^+ - H_2O$ | 4%<br>87%<br>9% | $M^{+\bullet}$<br>$M + H^+ - H_2O$<br>$M + H^+ - 2H_2O$ | 73%<br>19%<br>8% |

REFERENCES

The following listed references are expressly incorporated by reference herein. Throughout the specification, these references are referred to by citing to the numbers in the brackets [#].

[1] Marshall, A. G.; Rodgers, R. P. Proc. Natl. Acad. Sci. U.S.A. 2008, 105, 18090-18095.

[2] Pinkston, D. S.; Duan, P.; Gallardo, V. A.; Habicht, S. C.; Tan, X.; Qian, K.; Gray, M.; Mullen, K.; Kenttämaa, H. I. Energy Fuels 2009, 23, 5564-5570.

[3] Crawford, K. E.; Campbell, J. L.; Fiddler, M. N.; Duan, P.; Qian, K.; Gorbaty, M. L.; Kenttämaa, H. I. Anal. Chem. 2005, 77, 7916-7923.

[4] Duan, P.; Qian, K.; Habicht, S. C.; Pinkston, D. S.; Fu, M.; Kenttämaa, H. I. Anal. Chem. 2008, 80, 1847-1853.

[5] Duan, P.; Fu, M.; Pinkston, D. S.; Habicht, S. C.; Kenttämaa, H. I. J. Am. Chem. Soc. 2007, 129, 9266-9267.

[6] Campbell, J. L.; Crawford, K. E.; Kenttämaa, H. I. Anal. Chem. 2004, 76, 959-963.

[7] Campbell, J. L.; Fiddler, M. N.; Crawford, K. E.; Gqamana, P. P.; Kenttämaa, H. I. Anal. Chem. 2005, 77, 4020-4026.

[8] Shea, R. C.; Petzold, C. J.; Campbell, J. L.; Li, S.; Aaserud, D. J.; Kenttämaa, H. I. Anal. Chem. 2006, 78, 6133-6139.

[9] Shea, R. C.; Habicht, S. C.; Vaughn, W. E.; Kenttämaa, H. I. Anal. Chem. 2007, 79, 2688-2694.

[10] Peng, W. P.; Yang, Y. C.; Kang, M. W.; Tzeng, Y. K.; Nie, Z. X.; Chang, H. C.; Chang, W.; Chen, C. H. Angew. Chem. Int. Edit. 2006, 45, 1423-1426.

[11] Habicht, S. C.; Amundson, L. M.; Duan, P. G.; Vinueza, N. R.; Kenttämaa, H. I. Anal. Chem. 2010, 82, 608-614.

[12] Cheng, S. C.; Cheng, T. L.; Chang, H. C.; Shiea, J. Anal. Chem. 2009, 81, 868-874.

[13] Horning, E. C.; Horning, M. G.; Carroll, D. I.; Dzidic, I.; Stillwel, R. N. Anal. Chem. 1973, 45, 936-943.

[14] Dzidic, I.; Carroll, D. I.; Stillwell, R. N.; Horning, E. C. Anal. Chem. 1976, 48, 1763-1768.

[15] Sunner, J.; Nicol, G.; Kebarle, P. Anal. Chem. 1988, 60, 1300-1307.

[16] Mcneal, C. J.; Macfarlane, R. D.; Thurston, E. L. Anal. Chem. 1979, 51, 2036-2039.

[17] Herrera, L. C.; Grossert, J. S.; Ramaley, L. J. Am. Soc. Mass Spectrom. 2008, 19, 1926-1941.

What is claimed is:

1. An apparatus for producing gaseous ions, comprising:

a laser-induced acoustic desorption probe, wherein the desorption probe includes a surface suitable for contact with an analyte; and an ion source that operates at atmospheric pressure, wherein said ion source produces a stream of ions and wherein the surface of the desorption probe is positioned such that it can introduce an analyte on the surface of the desorption probe into the stream of ions produced by the ion source.

2. The apparatus according to claim 1, wherein the apparatus is suitable for providing at least one ionized analyte or fragment thereof into the sample inlet of a mass spectrometer.

3. The apparatus according to claim 1, wherein the ion source is an atmospheric pressure chemical ionization source.

4. The apparatus according to claim 1, wherein the ion source is an atmospheric pressure photo ionization source.

5. The apparatus according to claim 2, wherein the mass spectrometer is a quadrupole ion trap mass spectrometer.

6. The apparatus according to claim 2, wherein the mass spectrometer is a Fourier-transform ion cyclotron resonance mass spectrometer.

7. The apparatus according to claim 2, wherein the mass spectrometer is a quadrupole/time-of-flight mass spectrometer.

8. The apparatus according to claim 1, wherein the desorption probe includes a neodymium doped yttrium aluminum garnet laser.

9. The apparatus according to claim 8, wherein the neodymium doped yttrium aluminum garnet laser operates at a range of between about 450 to about 600 nm.

10. The apparatus according to claim 8, wherein the neodymium doped yttrium aluminum garnet laser operates at a range of between about 950 to about 1200 nm.

11. The apparatus according to claim 1, wherein the desorption probe includes a foil surface, the surface having a first side and a second side and where the laser is focus on the first side of the foil and a sample is applied to the second side of the foil and the laser can be pulsed so as to minimize the heating of the sample on the second side of the foil.

12. The apparatus according to claim 11, wherein the laser is pulsed between about 150 to about 200 times per second.

13. The apparatus according to claim 3, wherein said atmospheric pressure ionization source produces a plasma that includes ionization products from at least one gas produced from the group of gasses consisting of but not limited to: nitrogen, carbon dioxide, xenon and CS.

14. The apparatus according to claim 3, wherein said atmospheric pressure ionization source produces a plasma that includes ionization products from at least one solvent produced from the group of solvents consisting of: methanol, methanol:water, benzene and carbon disulfide.

15. The apparatus according to claim 3, wherein said atmospheric pressure ionization source produces a plasma that includes ionization products from at least one gas produced from the group of gasses consisting of: nitrogen, carbon dioxide, xenon and CS and at least one solvent produced from the group of solvents consisting of: methanol, methanol:water, benzene and carbon disulfide.

16. An apparatus for analyzing a compound, comprising:

a laser-induced acoustic desorption probe, wherein the desorption probe includes a surface suitable for contact with an analyte;

an ion source that operates at atmospheric pressure, wherein said ion source produces a stream of ions and wherein the surface of the desorption probe is positioned such that it can introduce an analyte on the surface of the desorption probe into the stream of ions produced by the ion source; and a mass spectrometer having a sample inlet, wherein the laser induced acoustic desorption probe is positioned such that the desorption probe desorbs at least a portion of the analyte on the surface of the desorption probe into the ion stream and a least a portion of the analyte or an ionized species or fragment thereof is introduced into the sample inlet of the mass spectrometer.

17. The apparatus according to claim 15, wherein the ion source is an atmospheric pressure chemical ionization source.

18. The apparatus according to claim 15, wherein the ion source is an atmospheric pressure photo ionization source.

19. The apparatus according to claim 15, wherein the mass spectrometer is a quadrupole ion trap mass spectrometer.

20. The apparatus according to claim 15, wherein the mass spectrometer is a quadrupole ion trap mass spectrometer.

21. The apparatus according to claim 15, wherein the mass spectrometer is a quadrupole/time-of-flight mass spectrometer.

22. The apparatus according to claim 15, wherein the desorption probe includes a neodymium doped yttrium aluminum garnet laser.

23. The apparatus according to claim 21, wherein the neodymium doped yttrium aluminum garnet laser operates at a range of between about 450 to about 600 nm.

24. The apparatus according to claim 21, wherein the neodymium doped yttrium aluminum garnet laser operates at a range of between about 900 to about 1200 nm.

25. The apparatus according to claim 16, wherein the desorption probe includes a foil surface, the surface having a first side and a second side and where the laser is focus on the first side of the foil and a sample is applied to the second side of the foil and the laser can be pulsed so as to minimize the heating of the sample on the second side of the foil.

26. The apparatus according to claim 24, wherein the laser is pulsed between about 150 to about 200 times per second.

27. The apparatus according to claim 16, wherein said atmospheric pressure ionization source produces a plasma that includes ionization products from at least one gas produced from the group of gasses consisting of: nitrogen, carbon dioxide, xenon and CS.

28. The apparatus according to claim 16, wherein said atmospheric pressure ionization source produces a plasma that includes ionization products from at least one solvent produced from the group of solvents consisting of: methanol, methanol:water, benzene and carbon disulfide.

29. The apparatus according to claim 16, wherein said atmospheric pressure ionization source produces a plasma that includes ionization products from at least one gas produced from the group of gasses consisting of: nitrogen, carbon dioxide, xenon and CS and at least one solvent produced from the group of solvents consisting of: methanol, methanol: water, benzene and carbon disulfide.

30. A method for analyzing a compound, comprising the steps of:

providing an apparatus, said apparatus including:

a laser-induced acoustic desorption probe, wherein the desorption probe includes a surface suitable for contact with an analyte;

an ion source that operates at atmospheric pressure, wherein said ion source produces a stream of ions; and a mass spectrometer having a sample inlet, wherein the laser induced acoustic desorption probe is positioned such that the desorption probe desorbs at least a portion of the analyte on the surface of the desorption probe into the ion stream and a least a portion of the analyte or an ionized species or fragment thereof is introduced into the sample inlet of the mass spectrometer;

supplying at least one analyte; and contacting the surface suitable for contact with an analyte with the analyte.

31. The method according to claim 29, wherein the analyte is a polar compound.

32. The method according to claim 29, wherein the analyte is a nonpolar compound.

33. The method according to claim 29, wherein the nonpolar compound is present in petroleum.

34. The method according to claim 29, wherein the nonpolar compound is a lipid.

35. The method according to claim 29, wherein the nonpolar compound is selected from the group consisting of bathophenanthrolines, Coronenes, squalenes, cholestanes, androsterones, and the like.

* * * * *

UNITED STATES PATENT AND TRADEMARK OFFICE

CERTIFICATE OF CORRECTION

PATENT NO. : 8,344,319 B2
APPLICATION NO. : 13/080597
DATED : January 1, 2013
INVENTOR(S) : Hilkka I. Kenttämaa et al.

It is certified that error appears in the above-identified patent and that said Letters Patent is hereby corrected as shown below:

In the Claims

In Claim 17, at column 20, line 33, please delete “15” and replace therewith --16--.
In Claim 18, at column 20, line 35, please delete “15” and replace therewith --16--.
In Claim 19, at column 20, line 37, please delete “15” and replace therewith --16--.
In Claim 20, at column 20, line 39, please delete “15” and replace therewith --16--.
In Claim 21, at column 20, line 41, please delete “15” and replace therewith --16--.
In Claim 22, at column 20, line 44, please delete “15” and replace therewith --16--.
In Claim 23, at column 20, line 47, please delete “21” and replace therewith --22--.
In Claim 24, at column 20, line 50, please delete “21” and replace therewith --22--.
In Claim 25, at column 20, line 53, please delete “16” and replace therewith --17--.
In Claim 26, at column 20, line 59, please delete “24” and replace therewith --25--.
In Claim 27, at column 20, line 61, please delete “16” and replace therewith --17--.
In Claim 28, at column 20, line 66, please delete “16” and replace therewith --17--.
In Claim 29, at column 21, line 4, please delete “16” and replace therewith --17--.
In Claim 31, at column 22, line 9, please delete “29” and replace therewith --30--.
In Claim 32, at column 22, line 11, please delete “29” and replace therewith --30--.
In Claim 33, at column 22, line 13, please delete “29” and replace therewith --30--.
In Claim 34, at column 22, line 15, please delete “29” and replace therewith --30--.
In Claim 35, at column 22, line 17, please delete “29” and replace therewith --30--.

Signed and Sealed this
Seventh Day of May, 2013

Teresa Stanek Rea
*Acting Director of the United States Patent and Trademark Office*